US007086467B2

(12) United States Patent
Schlegelmilch et al.

(10) Patent No.: US 7,086,467 B2
(45) Date of Patent: Aug. 8, 2006

(54) COILED TUBING CUTTER

(75) Inventors: Tye Schlegelmilch, New York, NY (US); Gary Rytlewski, League City, TX (US); Vance Nixon, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 200 days.

(21) Appl. No.: 10/321,217

(22) Filed: Dec. 17, 2002

(65) Prior Publication Data

US 2003/0127231 A1 Jul. 10, 2003

Related U.S. Application Data

(60) Provisional application No. 60/341,449, filed on Dec. 17, 2001.

(51) Int. Cl.
*E21B 29/00* (2006.01)
*E21B 33/35* (2006.01)
*E21B 33/64* (2006.01)

(52) U.S. Cl. ..... 166/298; 166/361; 166/368; 166/86.3

(58) Field of Classification Search ..... 166/335, 166/340, 361, 359, 360, 363, 364, 367, 368, 166/297, 298, 55, 377, 75.11, 86.1, 86.3, 166/55.2, 55.3, 55.6, 54.5, 54.6
See application file for complete search history.

(56) References Cited

U.S. PATENT DOCUMENTS 2,919,111 A * 12/1959 Nicolson ..... 166/352
3,561,526 A * 2/1971 Williams et al. ..... 166/55
3,590,920 A * 7/1971 Orund et al. ..... 166/55
3,692,107 A * 9/1972 Slator et al. ..... 166/55
3,736,982 A * 6/1973 Vujasinovic ..... 166/55
3,766,979 A * 10/1973 Petrick ..... 166/55
3,782,459 A * 1/1974 Murray ..... 166/355
3,817,326 A * 6/1974 Meynier, III ..... 166/55
3,848,667 A * 11/1974 Clark, Jr. ..... 166/55.6
3,870,098 A * 3/1975 Houston ..... 166/55.1
3,870,101 A * 3/1975 Helmus ..... 166/363
3,946,806 A * 3/1976 Meynier, III ..... 166/55
4,009,753 A * 3/1977 McGill et al. ..... 166/55.1
4,043,389 A * 8/1977 Cobb ..... 166/55
4,132,265 A * 1/1979 Williams, Jr. ..... 166/55
4,132,266 A * 1/1979 Randall ..... 166/55
4,132,267 A * 1/1979 Jones ..... 166/55
4,160,478 A * 7/1979 Calhoun et al. ..... 166/55.1

(Continued)

FOREIGN PATENT DOCUMENTS

EP 0 943 781 A3 1/2002

(Continued)

*Primary Examiner*—Jennifer H. Gay
(74) *Attorney, Agent, or Firm*—Trap, Pruner & Hu, P.C.; Bryan P. Galloway; Jaime A. Castaño

(57) ABSTRACT

A subsea production system includes a blowout preventer stack that is adapted to seal and contain pressure in a well. The blowout preventer stack has a passageway through which a tubular string may extend into the well. The subsea production system includes a subsea wellhead and a safety shut-in system that has a valve assembly that is adapted to control flow and adapted to allow tools to be lowered therethrough on tubing. The subsea production system includes a cutting module that is adapted to be run into the passageway to allow tools to be lowered therethrough on tubing. The cutting module is further adapted to activate to shear the tubing that is lowered therethrough.

32 Claims, 6 Drawing Sheets

U.S. PATENT DOCUMENTS 4,163,477 A * 8/1979 Johnson et al. ..... 166/363
4,215,749 A 8/1980 Dare et al.
4,240,503 A * 12/1980 Holt et al. ..... 166/55
4,290,277 A * 9/1981 Valliere ..... 66/24
4,305,565 A * 12/1981 Abbe ..... 251/1.3
4,313,496 A * 2/1982 Childs et al. ..... 166/55
4,323,117 A * 4/1982 Pierce ..... 166/55
4,420,042 A * 12/1983 Tunstall ..... 166/297
4,523,639 A * 6/1985 Howard, Jr. ..... 166/55
4,537,250 A * 8/1985 Troxell, Jr. ..... 166/55
4,540,046 A * 9/1985 Granger et al. ..... 166/55
4,580,626 A * 4/1986 Jones ..... 166/55
4,646,825 A * 3/1987 Van Winkle ..... 166/55
4,685,521 A * 8/1987 Raulins ..... 166/341
4,923,005 A * 5/1990 Laky et al. ..... 166/55
5,002,130 A * 3/1991 Laky ..... 166/351
5,360,061 A * 11/1994 Womble ..... 166/55
5,515,916 A * 5/1996 Haley ..... 166/55
5,647,572 A * 7/1997 Morrill ..... 251/1.3
5,735,502 A * 4/1998 Levett et al. ..... 251/1.3
5,984,012 A * 11/1999 Wactor et al. ..... 166/364
6,053,252 A * 4/2000 Edwards ..... 166/348
6,125,928 A * 10/2000 Ninivaara et al. ..... 166/55
6,173,770 B1 * 1/2001 Morrill ..... 166/85.4
6,183,165 B1 * 2/2001 Heinrichs et al. ..... 405/195.1
6,293,344 B1 * 9/2001 Nixon et al. ..... 166/363
6,651,746 B1 * 11/2003 Boyd ..... 166/379
6,719,042 B1 * 4/2004 Johnson et al. ..... 166/55
2001/0035287 A1 * 11/2001 Collie ..... 166/54.5
2001/0050172 A1 * 12/2001 Tolman et al. ..... 166/297
2003/0132004 A1 * 7/2003 Suro ..... 166/380
2004/0003919 A1 * 1/2004 Johnson et al. ..... 166/55

FOREIGN PATENT DOCUMENTS

GB 2 184 762 A 7/1987

* cited by examiner

COILED TUBING CUTTER

This application claims the benefit of U.S. Provisional Application No. 60/341,449 filed Dec. 17, 2001.

FIELD OF THE INVENTION

The present invention relates generally to safety shut-in systems employed during testing or other operations in subsea wells. More specifically, the invention relates to a coiled tubing cutter for use with a safety shut-in system in a subsea well.

BACKGROUND OF THE INVENTION

Offshore systems which are employed in relatively deep water for well operations generally include a riser which connects a surface vessel's equipment to a blowout preventer stack on a subsea wellhead. The marine riser provides a conduit through which tools and fluid can be communicated between the surface vessel and the subsea well.

Offshore systems which are employed for well testing operations also typically include a safety shut-in system which automatically prevents fluid communication between the well and the surface vessel in the event of an emergency, such as loss of vessel positioning capability. Typically, the safety shut-in system includes a subsea test tree which is landed inside the blowout preventer stack on a pipe string.

The subsea test tree generally includes a valve portion which has one or more normally closed valves that can automatically shut-in the well. The subsea test tree also includes a latch portion which enables the portion of the pipe string above the subsea test tree to be disconnected from the subsea test tree.

If an emergency condition arises during the deployment of tools on coiled tubing, for example, the safety shut-in system is first used to sever the coiled tubing. In a typical safety shut-in system, a ball valve performs both the function of severing the coiled tubing and the function of shutting off flow.

Although somewhat effective, the use of ball valves to sever the coiled tubing has proven difficult with larger sizes of coiled tubing. Additionally, use of the ball valves to perform cutting operations can have detrimental sealing effects on the sealing surfaces of the valve. Specifically, the sealing surfaces can become scarred, reducing the sealing efficiency.

There exists, therefore, a need for an efficient coiled tubing cutter.

DETAILED DESCRIPTION

It should be clear that the present invention is not limited to use with the particular embodiments of the subsea systems shown, but is equally used to advantage on any other well system in which severing of coiled tubing, wireline, slickline, or other production or communication lines may become necessary.

Furthermore, although the invention is primarily described with reference to intervention tools deployed on coiled tubing, it should be understood that the present invention can be used to advantage to sever wireline, slickline, or other production or communication line as necessary.

Figure 1:
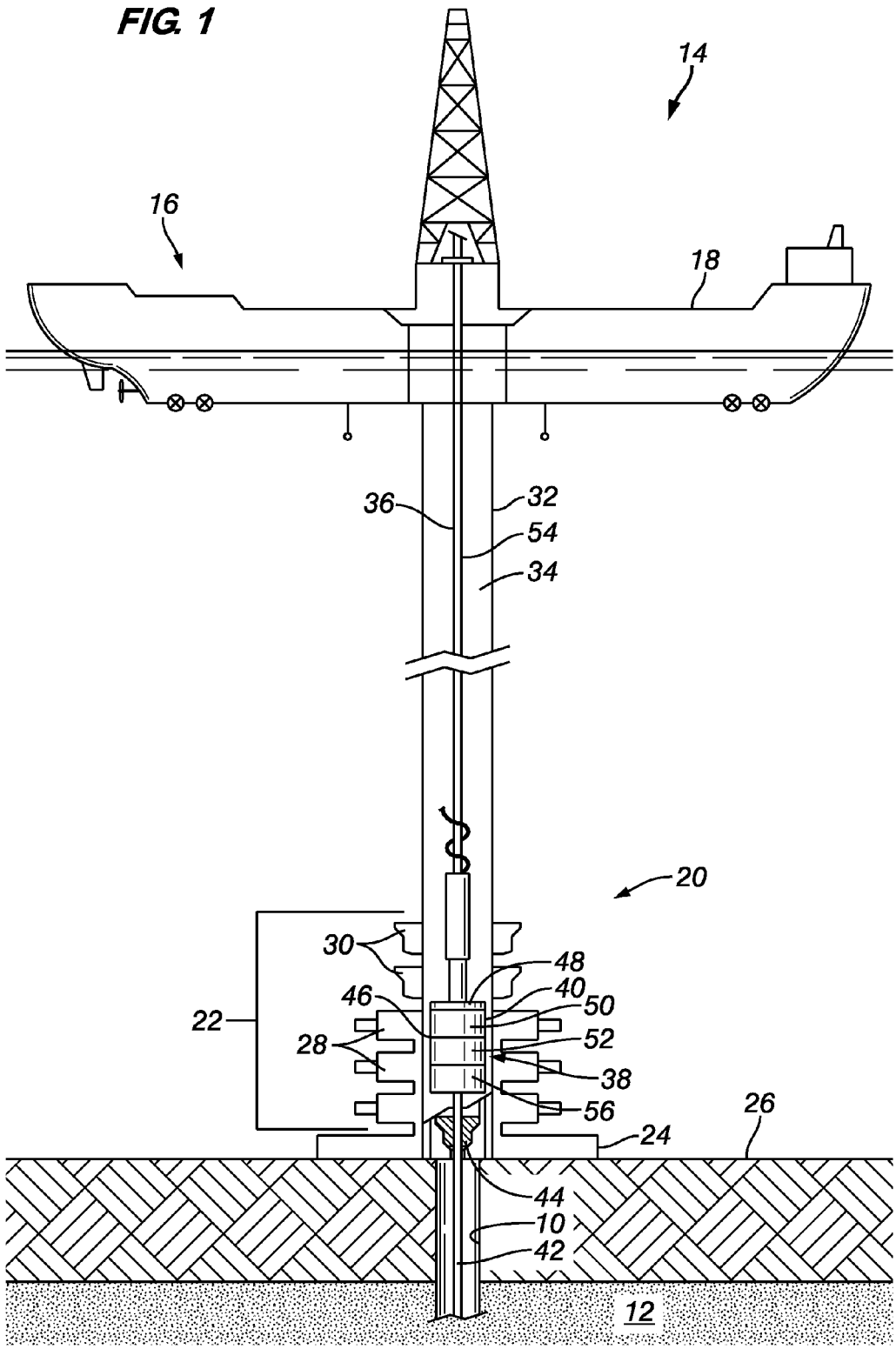
FIG. 1 illustrates an offshore system with a subsea tree having an embodiment of the cutting module of the present invention.

Referring to the drawings wherein like characters are used for like parts throughout the several views, FIG. 1 depicts a well 10 which traverses a fluid reservoir 12 and an offshore system 14 suitable for testing productivity of the well 10. The offshore system 14 comprises a surface system 16, which includes a production vessel 18, and a subsea system 20, which includes a blowout preventer stack 22 and a subsea wellhead 24.

The subsea wellhead 24 is fixed to the seafloor 26, and the blowout preventer stack 22 is mounted on the subsea wellhead 24. The blowout preventer stack 22 includes ram preventers 28 and annular preventers 30 which may be operated to seal and contain pressure in the well 10. A marine riser 32 connects the blowout preventer stack 22 to the vessel 18 and provides a passage 34 through which tools and fluid can be communicated between the vessel 18 and the well 10. In the embodiment shown, the tubing string 36 is located within the marine riser 32 to facilitate the flow of formation fluids from the fluid reservoir 12 to the vessel 18.

The subsea system 20 includes a safety shut-in system 38 which provides automatic shut-in of the well 10 when conditions on the vessel 18 or in the well 10 deviate from preset limits. The safety shut-in system 38 includes a subsea tree 40 that is landed in the blowout preventer stack 22 on the tubing string 36. A lower portion 42 of the tubing string 36 is supported by a fluted hanger 44.

The subsea tree 40 has a valve assembly 46 and a latch 48. The valve assembly 46 acts as a master control valve during testing of the well 10. The valve assembly 46 includes a normally-closed flapper valve 50 and a normally-closed ball valve 52. The flapper valve 50 and the ball valve 52 may be operated in series. The latch 48 allows an upper portion 54 of the tubing string 36 to be disconnected from the subsea tree 40 if desired.

In an embodiment of the present invention, the subsea tree 40 further comprises a cutting module 56 having opposing shear blades 58. The cutting module 56 is located below the valve assembly 46. If an emergency condition arises during deployment of intervention tools lowered through the tubing string 36 on coiled tubing, the blades 58 of the cutting module 56 are activated to sever the coiled tubing prior to the well being shut-in.

Figure 2:
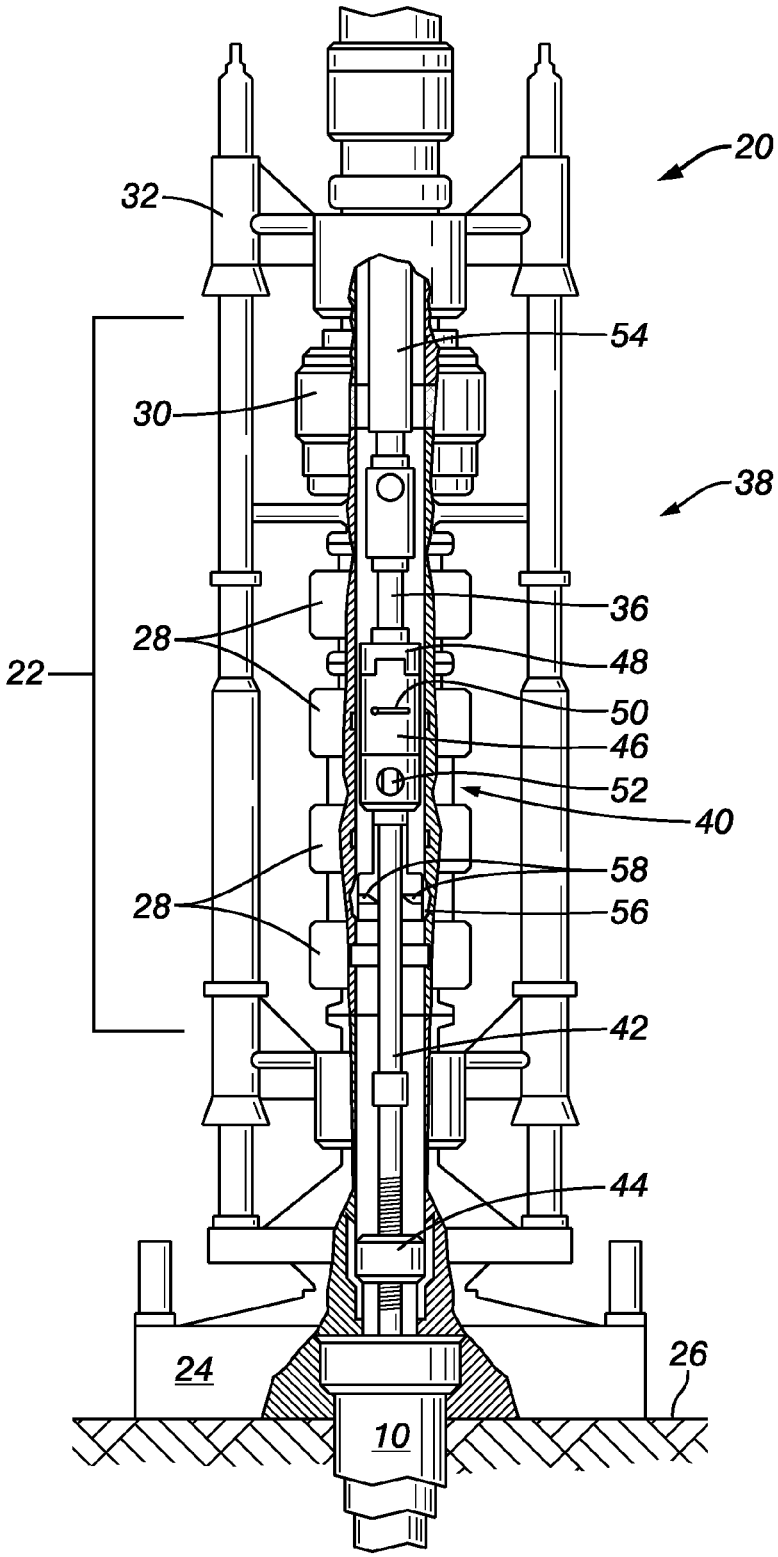
FIG. 2 illustrates a subsea system with a subsea tree having an embodiment of the cutting module of the present invention.

FIG. 2 illustrates a subsea system 20 having an embodiment of the cutting module 56 of the present invention. The subsea system 20 is adapted to facilitate production from a well 10 to an offshore vessel (not shown). The subsea system includes a blowout preventer stack 22, a subsea wellhead 24, and a safety shut-in system 38. The subsea wellhead 24 is fixed to the seafloor 26, and the blowout preventer stack 22 is mounted on the subsea wellhead 24. The blowout preventer stack 22 includes ram preventers 28 and annular preventers 30 which may be operated to seal and contain pressure in the well 10. A marine riser 32 connects the blowout preventer stack 22 to an offshore vessel and provides a passage through which tools and fluid can be communicated between the vessel and the well 10. In the embodiment shown, the tubing string 36 is located within the marine riser 32 to facilitate the flow of formation fluids from the fluid reservoir to the vessel.

The safety shut-in system 38 of the subsea system 20 provides automatic shut-in of the well 10 when conditions on the vessel deviate from preset limits. The safety shut-in system 38 includes a subsea tree 40 that is landed in the blowout preventer stack 22 on the tubing string 36. A lower portion 42 of the tubing string 36 is supported by a fluted hanger 44. The subsea tree 40 has a valve assembly 46 and a latch 48. The valve assembly 46 acts as a master control valve during testing of the well 10. The valve assembly 46 includes a normally-closed flapper valve 50 and a normally-closed ball valve 52. The flapper valve 50 and the ball valve 52 may be operated in series. The latch 48 allows an upper portion 54 of the tubing string 36 to be disconnected from the subsea tree 40 if desired.

Housed within the subsea tree 40 is an embodiment of the cutting module 56 of the present invention. The cutting module 56 is located below the valve assembly 46 and is shown in FIG. 2 with its blades 58 in their open position. If an emergency condition arises during deployment of intervention tools lowered through the tubing string 36 on coiled tubing, the blades 58 of the cutting module 56 are activated to sever the coiled tubing prior to the well being shut-in.

Figure 3:
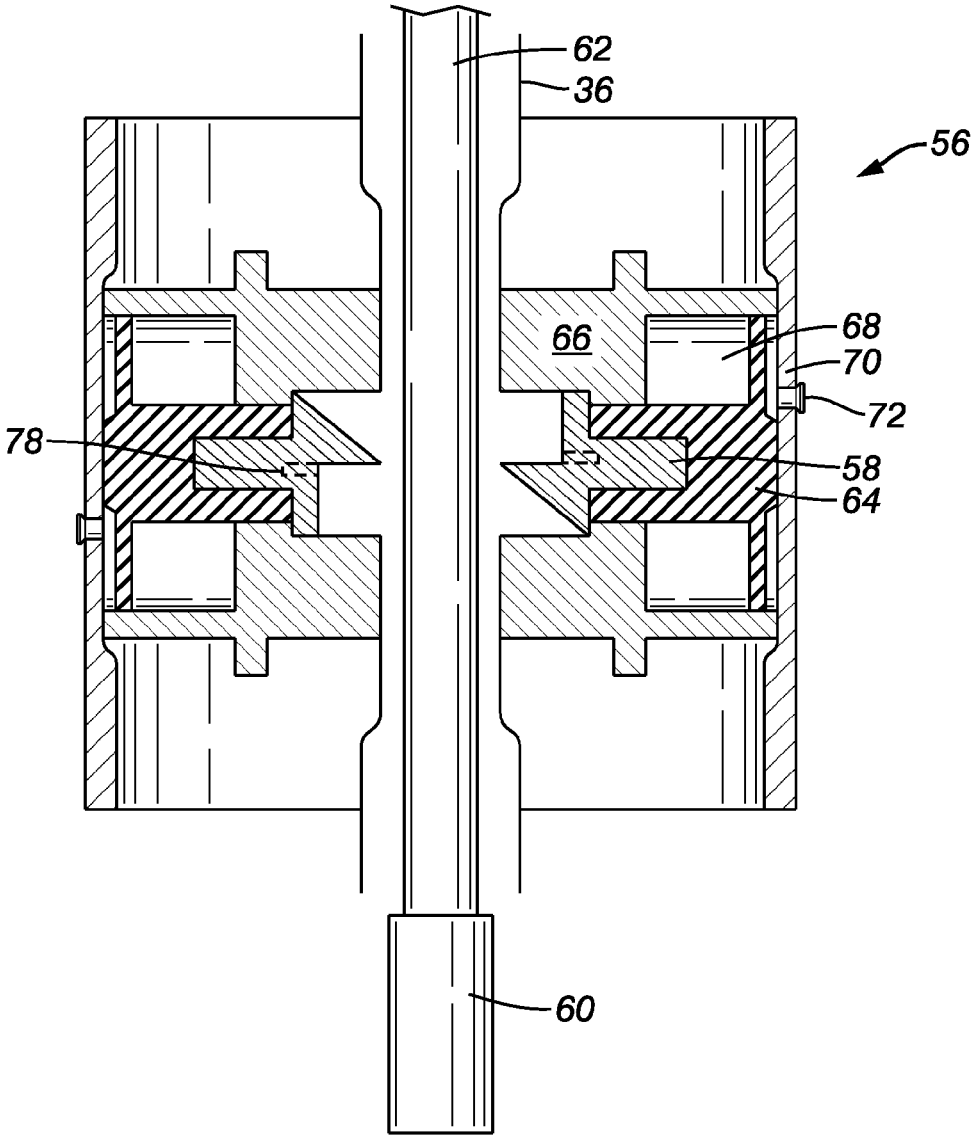
FIG. 3 shows an embodiment of the cutting module of the present invention with its blades in their open position.

FIG. 3 shows an embodiment of the cutting module 56 of the present invention with its blades 58 in their open position. An intervention tool 60 is lowered through the cutting module 56 on coiled tubing 62.

The blades 58 are shown in their open position and are affixed to a piston 64 located within a piston housing 66. A pressure chamber 68 is defined by the piston housing 66 and the outer wall 70 of the cutting module 56. One or more pressure ports 72 are located in the outer wall 70 of the cutting module 56 and enable communication of fluid (e.g., gas, hydraulic, etc.) pressure via control lines (not shown) into the pressure chamber 68.

To activate the blades 58, fluid pressure is supplied by the control lines to the one or more pressure ports 72. The fluid pressure acts to push the pistons 64 toward the coiled tubing 62 until the blades 58 overlap and shear the coiled tubing 62 running within. After the coiled tubing 62 has been cut by the blades 58, the fluid pressure supplied by the control lines is discontinued and the pressurized pistons 64 and blades 58 return to their open state as a result of the much higher bore pressure existing within the tubing string 36.

In some embodiments, to accommodate the overlap of the blades 58, hollow slots 78 (shown in hidden lines) are provided in the face of the opposing blades 58.

Figure 4:
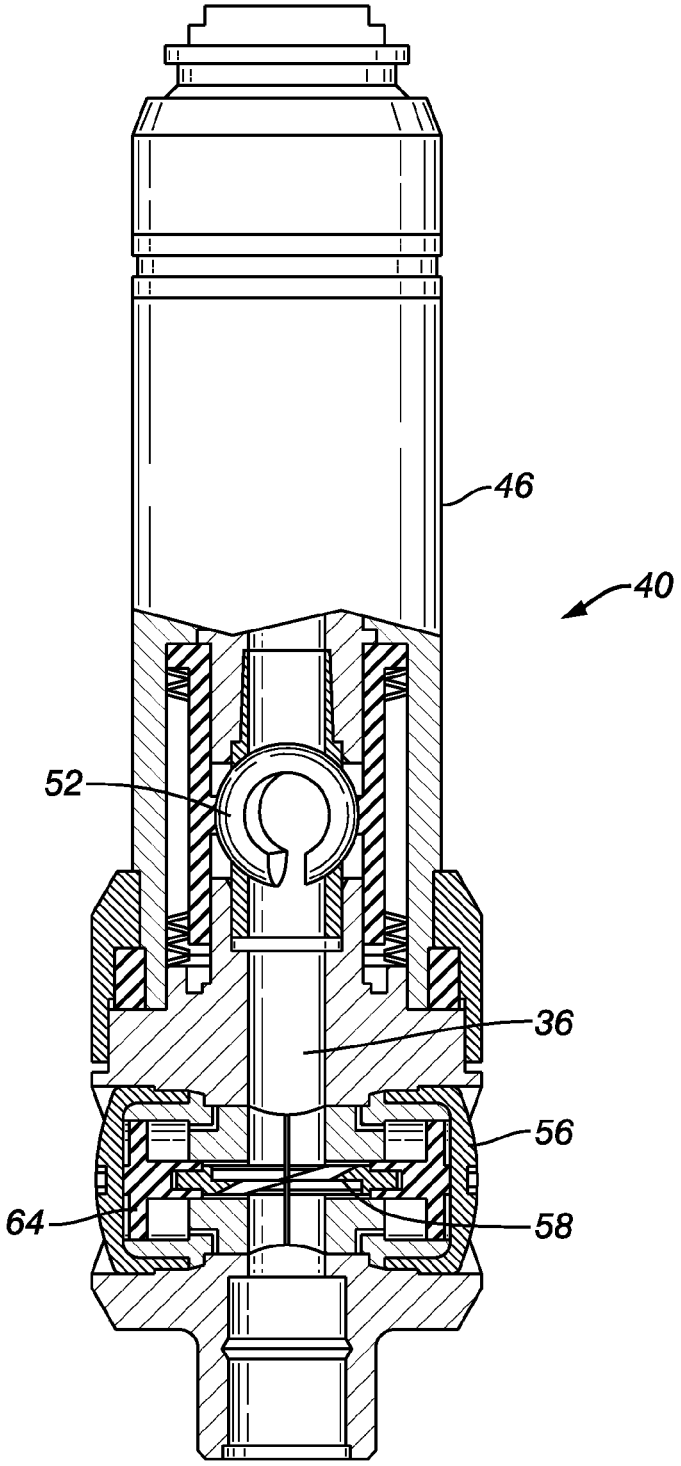
FIG. 4 illustrates an embodiment of the cutting module housed within a subsea tree and with its cutting blades activated.

FIG. 4 illustrates an embodiment of the cutting module 56 with the cutting blades 58 activated. The cutting module 56 is housed within a subsea tree 40 that includes a valve assembly 46 having a ball valve 52. The cutting module 56 is located below the ball valve 52.

Upon activation by applying pressure to the piston 64, the cutting blades 58 act to sever any coiled tubing located within the cutting module 56. After the coiled tubing has been severed and removed from the subsea tree 40, the ball valve 52 is closed to shut-in the well.

The blades 58 utilized by the cutting module 56 are designed specifically for cutting and thus provide a more efficient cut than traditional equipment such as ball valves used to cut coiled tubing. In tests conducted within Schlumberger's labs, the efficiency of a ball valve in cutting is approximately 20% versus a basic shear approximation. By contrast, the cutting blades 58 of the cutting module 56 have shown an efficiency of over 100%.

Additionally, cutting large diameter coiled tubing with ball valves can require the coiled tubing to be subjected to a large amount of tension. By contrast, the cutting module 56 of the present invention can cut larger diameter coiled tubing in the absence of tension.

The blades 58 of the cutting module 56 are designed to prevent the collapse of the coiled tubing being cut. As a result, the cut coiled tubing is much easier to fish following the severing process. While any number of blade geometries can be used to advantage by the present invention, for purpose of illustration, two example geometries are shown in FIGS. 5 and 6.

Figure 5:
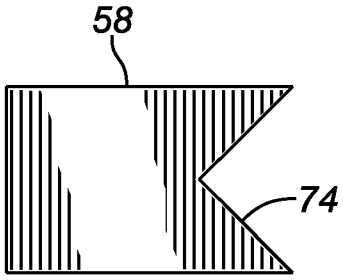
FIG. 5 provides a top view of the V-shaped geometry of one embodiment of the cutting blades.
Figure 6:
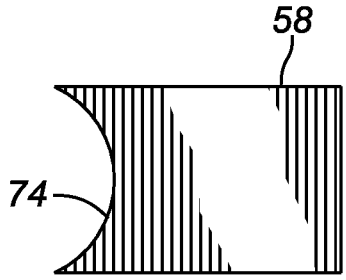
FIG. 6 provides a top view of the curved radii geometry of one embodiment of the cutting blades.

In the top view illustration of FIG. 5, the cutting surface 74 has a V-shaped geometry that acts to prevent the collapse of the coiled tubing being cut. Similarly, in the top view illustration of FIG. 6, the cutting surface 74 of the cutting blade 58 has a curved radii that closely matches the diameter of the coiled tubing deployed therebetween. Both geometries act to prevent the collapse of the coiled tubing to enable easier fishing operations.

As stated above, any number of blade geometries can be used to advantage to sever without collapsing the coiled tubing. In fact, most shapes, other than flat blade ends, will accomplish the same.

In other embodiments the cutting module 56 utilizes telescoping pistons. Due to the limited size in the tubing string 36 within which to hold cutting equipment, the use of telescoping pistons enables greater travel of the pistons, and thus attached blades, than that achievable with traditional pistons.

Figure 7:
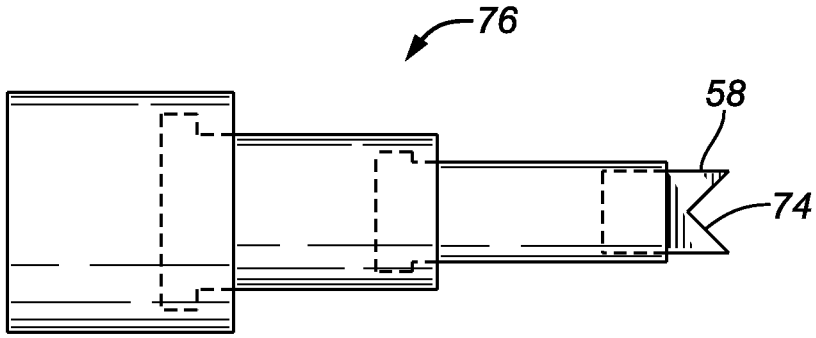
FIG. 7 provides a top view of an embodiment of the cutting module having telescoping pistons.
Figure 8:
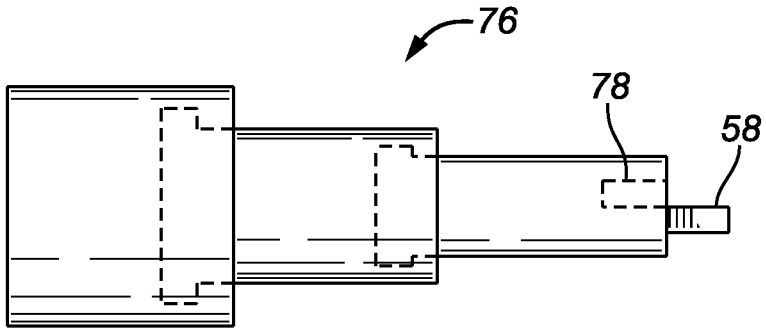
FIG. 8 provides a side view of an embodiment of the cutting module having telescoping pistons.

An embodiment of the telescoping pistons 76 is illustrated in FIGS. 7 and 8. FIG. 7 provides a top view of the telescoping piston 76 and FIG. 8 provides a side view.

The telescoping pistons 76 utilize multiple piston layers and a cutting blade 58. In the embodiment shown, the cutting surface 74 of the cutting blade 58 is a V-shaped geometry. However, it should be understood that a curved radii or other applicable geometry can be used to advantage.

The cutting module 56 utilizes two telescoping pistons 76 that lie opposite of each other. Upon pressurization, the piston layers begin their stroke and expand to a length greater than that achievable with a traditional piston. The telescoping pistons 76 expand until they overlap and the blades 58 shear any material running between them. To allow for the overlap, hollow slots 78 are provided on the face of the pistons 76 above one of the blades 58 and below the mating blade 58.

Following the cutting procedure, the supplied pressure is discontinued and the non-pressurized piston layers of the telescoping pistons 76 return to their non-extended positions as a result of the much higher bore pressure within the tubing string.

In operation, and with reference to FIG. 1, the subsea tree 40 is landed in the blowout preventer stack 22, comprising ram preventers 28 and annular preventers 30, on the tubing string 36. The flapper valve 50 and the ball valve 52 in the subsea tree 40 are open to allow fluid flow from the lower portion 42 of the tubing string 36 to the upper portion 54 of the tubing string 36. Additionally, the open valves 50, 52 allow for tools to be lowered via coiled tubing (or wireline, slickline, communication lines, etc.) through the tubing string 36 to perform intervention operations.

In the event of an emergency during an intervention operation, the cutting module 56 is activated to sever the coiled tubing. Once severed, coiled tubing remaining in the upper portion 54 of the tubing string 36 is raised until its severed end clears both the ball valve 52 and the flapper valve 50 of the valve assembly 46. At this point, the valves 50, 52 can be automatically closed to prevent fluid from flowing from the lower portion 42 of the tubing string 36 to the upper portion 54 of the tubing string 36. Once the valves 50, 52 are closed, the latch 48 is released enabling the upper portion 54 of the tubing string 36 to be disconnected from the subsea tree 40 and retrieved to the vessel 18 or raised to a level which will permit the vessel 18 to drive off if necessary.

After the emergency situation, the vessel 18 can return to the well site and the marine riser 32 can be re-connected to the blowout preventer stack 22. The safety shut-in system 38 can be deployed again and the coiled tubing that remains in the lower portion 42 of the tubing string 36 can be retrieved through various fishing operations.

It is important to note that the above embodiment is useful in both vertical and horizontal wells. Because the cutting module 56 severs the coiled tubing below the valves 50, 52, the severed portion of the coiled tubing will not interfere with the closing of the valves 50, 52.

Figure 9:
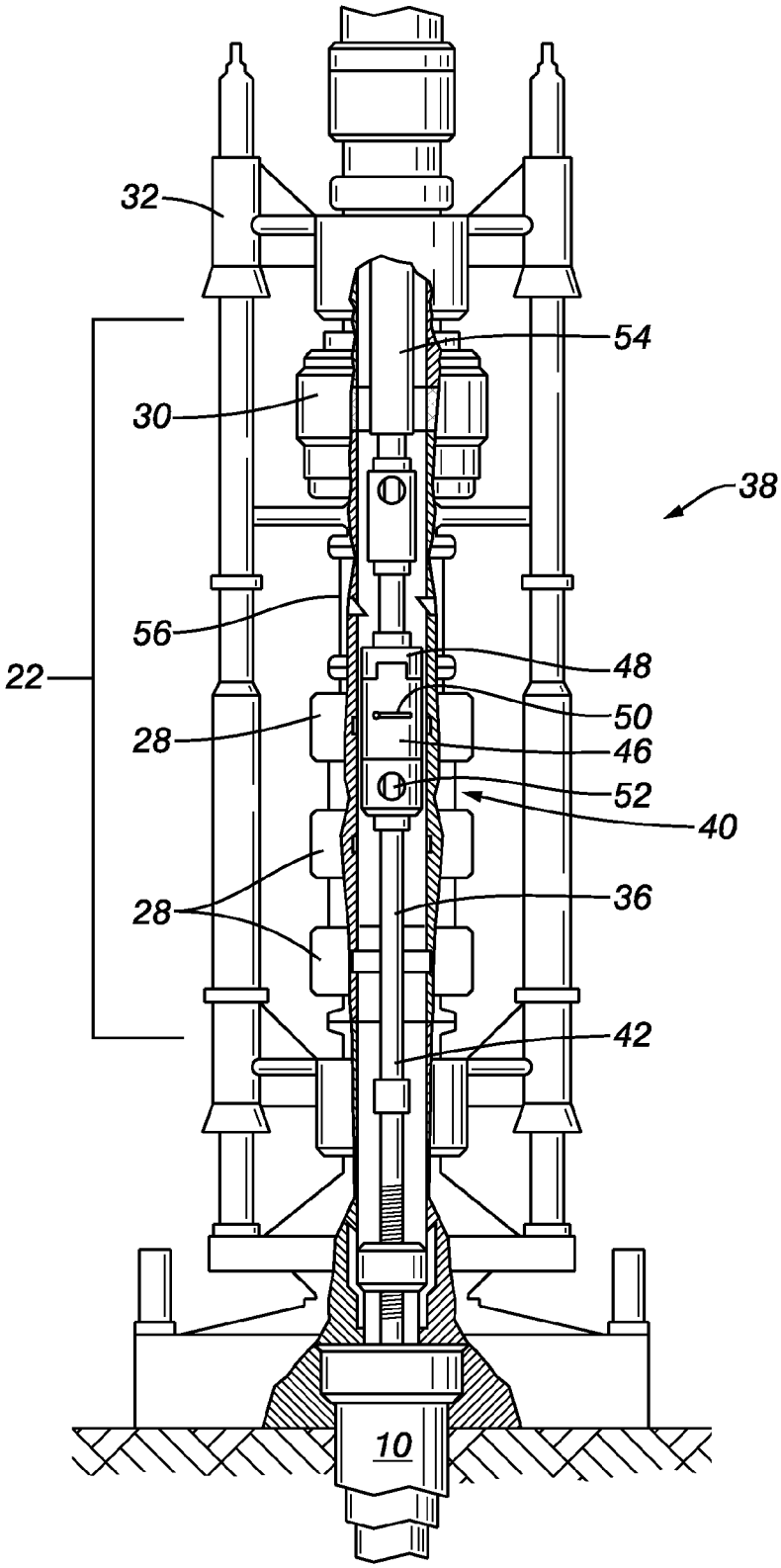
FIG. 9 illustrates an embodiment of the cutting module wherein the cutting module is located below the ball valve.

Another embodiment of the present invention is shown in FIG. 9. In this embodiment, the cutting module 56 is located above the flapper valve 50 and the ball valve 52. As such, this embodiment is useful in vertical wells.

In operation, the subsea tree 40 is landed in the blowout preventer stack 22, comprising ram preventers 28 and annular preventers 30, on the tubing string 36. The flapper valve 50 and the ball valve 52 in the subsea tree 40 are open to allow fluid flow from the lower portion 42 of the tubing string 36 to the upper portion 54 of the tubing string 36. Additionally, the open valves 50, 52 allow for tools to be lowered via coiled tubing (or wireline, slickline, communication lines, etc.) through the tubing string 36 to perform intervention operations.

In the event of an emergency during an intervention operation, the cutting module 56 is activated to sever the coiled tubing. Once severed, coiled tubing remaining in the lower portion 42 of the tubing string 36 falls within the vertical well until it has cleared both the ball valve 52 and the flapper valve 50 of the valve assembly 46. At this point, the valves 50, 52 can be automatically closed to prevent fluid from flowing from the lower portion 42 of the tubing string 36 to the upper portion 54 of the tubing string 36. Once the valves 50, 52 are closed, the latch 48 is released to enable the upper portion 54 of the tubing string 36 to be disconnected from the subsea tree 40 and retrieved to the vessel (not shown) or raised to a level which will permit the vessel to drive off if necessary.

After the emergency situation, the vessel can return to the well site and the marine riser 32 can be re-connected to the blowout preventer stack 22. The safety shut-in system 38 can be deployed again and the coiled tubing that remains in the lower portion 42 of the tubing string 36 can be retrieved through various fishing operations.

While the invention has been described with respect to a limited number of embodiments, those skilled in the art will appreciate numerous variations therefrom without departing from the spirit and scope of the invention.

What is claimed is:

1. A subsea production system, comprising:

a blowout preventer stack adapted to seal and contain pressure in a well, the blowout preventer having a passageway through which a tubular string may extend into the well;

a subsea wellhead;

a safety shut-in system having a valve assembly adapted to control flow and adapted to allow tools to be lowered therethrough on tubing; and a cutting module located below the valve assembly and adapted to be run into the passageway and adapted to allow tools to be lowered into the passageway an tubing, the cutting module further adapted to activate to shear the tubing lowered into the passageway.

2. The subsea production system of claim 1, wherein the valve assembly comprises at least one ball valve.

3. The subsea production system of claim 1, wherein the tubing is coiled tubing.

4. The subsea production system of claim 1, wherein the cutting module comprises opposing shear blades adapted to overlap upon activation of the cutting module.

5. The subsea production system of claim 4, wherein the opposing shear blades have a V-shaped cutting surface.

6. The subsea production system of claim 4, wherein the opposing shear blades have a curved radii cutting surface.

7. The subsea production system of claim 4, wherein the opposing shear blades are affixed to opposing pistons.

8. The subsea production system of claim 7, wherein the pistons are telescoping pistons.

9. The subsea production system of claim 1, wherein the cutting module is activated by fluid pressure.

10. The subsea production system of claim 9, wherein the fluid pressure is supplied by control lines.

11. The subsea production system of claim 9, wherein the fluid pressure is annular hydraulic pressure.

12. The subsea production system of claim 1, wherein the blowout preventer stack comprises at least one ram preventer.

13. The subsea production system of claim 1, wherein the cutting module is run into the blowout preventer stack after the blowout preventer stack is installed in the subsea production system.

14. The subsea production system of claim 1, wherein the cutting module is adapted to be landed in the blowout preventer stack.

15. The subsea production system of claim 1, wherein the cutting module is separate from the blowout preventer stack.

16. A safety shut-in system for a well, comprising:

a valve assembly adapted to control flow and allow tubing deployed tools to be lowered therethrough; and a cutting module located below the valve assembly and adapted to be landed within a blowout preventer stack and allow tubing deployed tools to be lowered therethrough, the cutting module having actuatable opposing shear blades adapted to sever tubing.

17. The safety shut-in system of claim 16, wherein the valve assembly comprises a normally closed flapper valve and a ball valve.

18. The safety shut-in system of claim 16, wherein the opposing shear blades are actuatable by fluid pressure.

19. A cutting module adapted for severing tubing in a well, comprising:

a pair of opposing pressure activated telescoping pistons, at least one of the pistons being expandable in length from a first retracted position to a second expanded position to sever the tubing; and shear blades affixed to the pistons such that the shear blades overlap upon activation of the pistons, wherein at least one of the pistons comprises:

a first member;

a second member slottably disposed inside the first member; and a third member slottably disposed inside the second member, a combined length of the first, second and third members is shorter in the retracted position of the piston than a combined length of the first, second and third members in the expanded position of the piston.

20. A method of severing coiled tubing downhole without collapsing the coiled tubing, comprising:

providing a cutting module comprising pressure activated opposing shear blades adapted to sever without collapsing the coiled tubing;

disposing the cutting module below a valve assembly adapted to control flow and adapted to allow tools to be lowered therethrough on tubing;

running the cutting module at least partially into a blowout preventer stack so that the cutting module is radially contained within at least part of a passageway of the blowout preventer stack through which a tubing string may extend into the well;

lowering coiled tubing therethrough the cutting module; and supplying pressure to the cutting module to activate the shear blades to sever the coiled tubing.

21. The method of claim 20, wherein the shear blades have V-shaped cutting surfaces.

22. The method of claim 20, wherein the shear blades have curved radii cutting surfaces.

23. The method of claim 20, further comprising:

landing the cutting module housing in a blowout preventer stack.

24. A subsea production system, comprising:

a blowout preventer stack adapted to seal and contain pressure in a well;

a subsea wellhead;

a safety shut-in system having a valve assembly adapted to control flow and adapted to allow tools to be lowered therethrough on tubing; and a cutting module located below the valve assembly and adapted to allow tools to be towered therethrough on tubing, the cutting module further adapted to activate to shear the tubing lowered therethrough.

25. The subsea production system of claim 24, wherein the valve assembly comprises at least one ball valve.

26. The subsea production system of claim 24, wherein the tubing comprises coiled tubing.

27. The subsea production system of claim 24, wherein the cutting module comprises opposing shear blades adapted to overlap upon activation of the cutting module.

28. The subsea production system of claim 24, wherein the opposing shear blades have a V-shaped cutting surface.

29. The subsea production system of claim 27, wherein the opposing shear blades have a curved radii cutting surface.

30. The subsea production system of claim 27, wherein the opposing shear blades are affixed to opposing pistons.

31. A safety shut-in system for a well, comprising:

a valve assembly adapted to control flow and allow tubing deployed tools to be lowered therethrough; and a cutting module located below the valve assembly and adapted to allow tubing deployed tools to be lowered therethrough, the cutting module having actuatable opposing shear blades adapted to sever tubing.

32. The safety shut-in system of claim 31, wherein the valve assembly comprises a normally closed flapper valve and a ball valve.

* * * * *